US008684100B2

(12) United States Patent
Tingler et al.

(10) Patent No.: US 8,684,100 B2
(45) Date of Patent: Apr. 1, 2014

(54) ELECTRICALLY ENGAGED, HYDRAULICALLY SET DOWNHOLE DEVICES

(75) Inventors: Kevin S. Tingler, Bartlesville, OK (US); John J. Mack, Catoosa, OK (US); Earl B. Brookbank, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 267 days.

(21) Appl. No.: 13/005,827

(22) Filed: Jan. 13, 2011

(65) Prior Publication Data

US 2012/0181049 A1 Jul. 19, 2012

(51) Int. Cl.
*E21B 33/12* (2006.01)

(52) U.S. Cl.
USPC ..... 166/387; 166/179

(58) Field of Classification Search
USPC ..... 166/118, 179, 387
See application file for complete search history.

(56) References Cited

U.S. PATENT DOCUMENTS

| | | | | |
|---|---|---|---|---|
| 4,515,213 | A | 5/1985 | Rogen et al. | |
| 4,619,320 | A | 10/1986 | Adnyana et al. | |
| 6,321,845 | B1 | 11/2001 | Deaton | |
| 6,446,717 | B1 * | 9/2002 | White et al. | 166/187 |
| 6,681,849 | B2 | 1/2004 | Goodson, Jr. | |
| 6,896,063 | B2 | 5/2005 | Chang et al. | |
| 7,352,111 | B2 | 4/2008 | Bagwell | |
| 2002/0157831 | A1 | 10/2002 | Kurlenya et al. | |
| 2003/0037921 | A1 | 2/2003 | Goodson, Jr. | |
| 2003/0075341 | A1 | 4/2003 | Kurlenya et al. | |
| 2007/0240877 | A1 | 10/2007 | O'Malley et al. | |
| 2008/0149348 | A1 * | 6/2008 | DiFoggio et al. | 166/381 |
| 2008/0296020 | A1 * | 12/2008 | Willauer | 166/280.1 |

OTHER PUBLICATIONS

Aliev, A. E. et al., "Giant-Stroke, Superelastic Carbon Nanotube Aerogel Muscles," Science, vol. 323, Mar. 20, 2009, pp. 1575-1578.
Riemenschneider, J. et al., Modeling of Carbon Nanotube Actuators: Part II—Mechanical Properties, Electro Mechanical Coupling and Validation of the Model, Journal of Intelligent Material Systems and Structures, vol. 20, Jan. 2009, pp. 253-263.
Riemenschneider, J. et al., Modeling of Carbon Nanotube Actuators: Part I—Modeling and Electrical Properties, Journal of Intelligent Material Systems and Structures, vol. 20, Jan. 2009, pp. 245-250.
International Search Report and Written Opinion dated Sep. 17, 2012 for International Application No. PCT/US2012/021251; all refereces in PCT cited above.

* cited by examiner

*Primary Examiner* — David Andrews
*Assistant Examiner* — Taras P Bemko
(74) *Attorney, Agent, or Firm* — Cantor Colburn LLP

(57) ABSTRACT

A method of performing a wellbore operation is disclosed. A device is provided that includes a material that expands from an original shape to an expanded shape when a selected charge is applied to material. The device is placed in the wellbore in the original shape. The selected charge is applied to the material to expand the material, causing a pressure differential across the device in the wellbore. A fluid is supplied into the device to set the device in the wellbore.

18 Claims, 3 Drawing Sheets

ELECTRICALLY ENGAGED, HYDRAULICALLY SET DOWNHOLE DEVICES

BACKGROUND OF THE DISCLOSURE

1. Field of the Disclosure

The present disclosure relates generally to packing devices for use in wellbores.

2. Description of the Related Art

Oil wells (also referred to "wells" as "wellbores") are drilled in earth formations for producing hydrocarbons (oil and gas) from subsurface hydrocarbon-bearing reservoirs. To produce hydrocarbons, a wellbore is drilled to a desired depth. A production string comprising equipment configured to retrieve the hydrocarbons is then placed in the drilled wellbore for producing hydrocarbons from one or more reservoirs, to be transported to the surface. Often, such equipment includes one or more packing elements (generally referred to as "packers") that are placed at selected locations in the wellbore to isolate certain sections of the wellbore. Generally, a packer includes a sealing member, made from an expandable material, such as rubber or a suitable polymer. Some packers use a bladder that is expanded by pumping a fluid therein. The outer surface of the expanded bladder presses against the inside of the wellbore or a pipe inserted into the wellbore, sealing the wellbore section below the packer from the wellbore section above the packer. Recently, shape-conforming memory materials have been proposed for use in packers. In such cases, the shape-conforming memory material in the packer is heated to or above its glass transition temperature to cause it to expand. The shape-conforming memory material is compressed to a desired shape. The packer containing compressed shape-conforming memory material is deployed in the well. Once deployed, the wellbore heat causes the shape-conforming memory material to expand to its initial shape, which shape is sufficient to press against the well wall or a tubular inside the well so as to seal the well section above the packer from the well section below the packer.

The present disclosure provides devices, such as packers, that may be electrically-engaged and hydraulically-set in a well.

SUMMARY OF THE DISCLOSURE

In one aspect, the disclosure provides a method of performing a wellbore operation that, in one embodiment, includes: providing a device comprising a material configured to expand from a first shape to a second shape upon application of a selected charge to the composite material; placing the device with the composite material in the original shape in a wellbore; applying the selected charge to the composite material to cause the composite material to expand from the first shape to the second shape to create a pressure differential across the device (between a section uphole the device and a section downhole of the device); and supplying a fluid into the device to increase pressure inside the device to provide a seal between the section uphole of the device and the section downhole of the device.

In another aspect, an apparatus for use in a wellbore is provided, which apparatus, in one embodiment, includes a device comprising a material configured to expand from a first shape to a second shape upon application of a selected charge to the material, a source of supplying the selected charge to the composite material when the device is in the wellbore, and a source of supplying a fluid into the device to cause the device to seal against an element in the wellbore.

Examples of certain features of the apparatus and methods disclosed herein are summarized rather broadly in order that the detailed description thereof that follows may be better understood. There are, of course, additional features of the apparatus and methods disclosed hereinafter that will form the subject of the claims.

BRIEF DESCRIPTION OF THE DRAWINGS

For detailed understanding of the present disclosure, references should be made to the following detailed description of the embodiments, taken in conjunction with the accompanying drawings, in which like elements have generally been given like numerals and wherein.

DESCRIPTION OF THE DISCLOSURE

Figure 1:
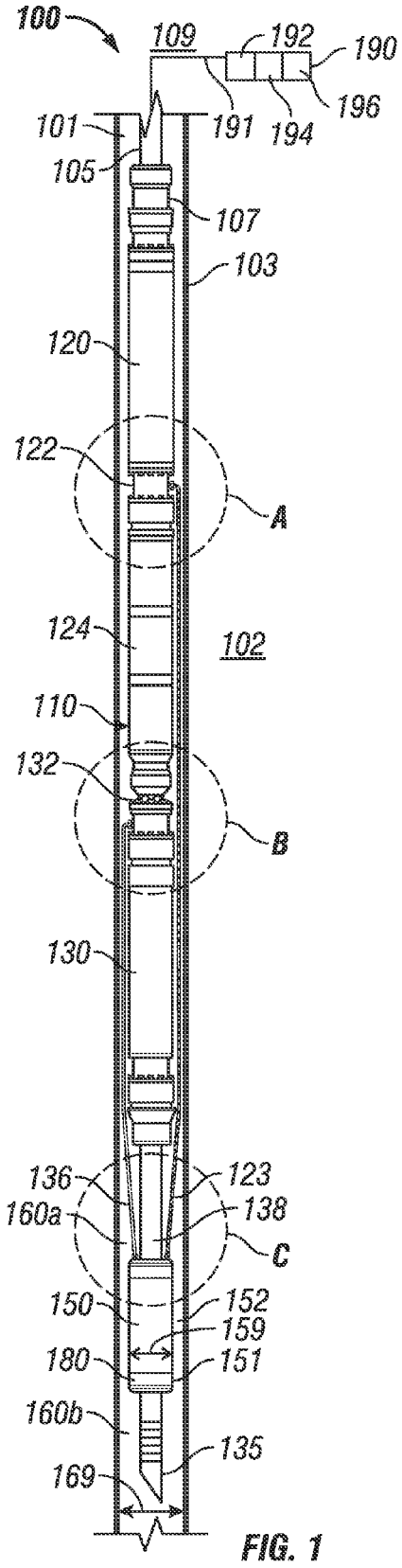
FIG. 1 shows a portion of an exemplary production string deployed in a wellbore that includes a packing device made according to one embodiment of the disclosure, wherein the packing element in the packing device is in an initial compressed shape.

FIG. 1 shows a portion of an exemplary production string (also referred to herein as the "string") 100 deployed in a wellbore 101 drilled in a formation 102. A casing 103 is shown placed along the length of the wellbore 101. In aspects, the string 100 includes an electrical-submersible pump 110 and a packing device 150 (also referred to herein as a "packer" or a "bladder"). A tubing 105 is run from a top end 107 of the electrical-submersible pump 110 to the surface 109. The tubing 105 forms a conduit for a fluid and may be utilized to run conductors or other links 191 therein to supply power to the electrical submersible pump 110 and other devices (also referred to as "downhole" devices) in the wellbore 101 and for data transmission between one or more downhole devices and the equipment at the surface 109. The electrical-submersible pump 110 includes an electrical motor (or "motor") 120 and a pump 130. The motor 120 terminates at a motor base 122. The pump 130 is coupled at its pump discharge head (pump head) 132 to the motor 120 via a motor seal 124. A pump intake 135 from a location below the packing device 150 provides a fluid path for the fluid from the wellbore inside to the pump. In other embodiments, a turbine driven by a motor or another suitable device may be utilized as the pump unit.

Figure 1A:
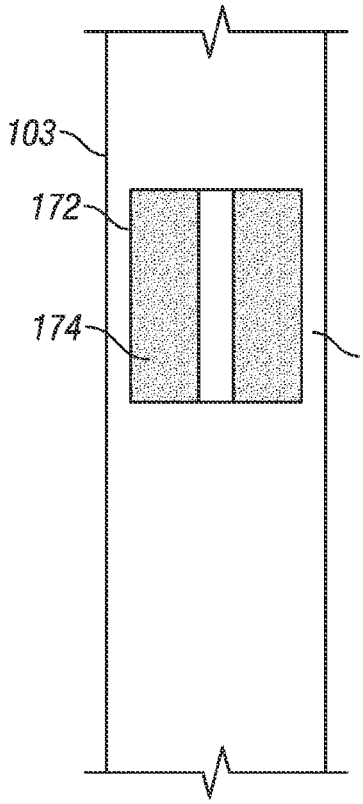
FIG. 1A shows a sectional view of the packing device of FIG. 1 with a polymer composite as the packing element in its initial compressed shape.

The packing device 150, made according to an embodiment of the disclosure, is shown deployed downhole of the pump 130 via a tubing 138. In one aspect, the packing device 150 may be expanded upon application of a selected charge to cause the packing device 150 to engage with the casing 103 and then hydraulically set to seal (or isolate) the wellbore annulus 160*a* above (or uphole) the packing device 150 from the wellbore annulus 160*b* below (or downhole) the packing device 150. The packing device 150 is deployed in the wellbore 101 with outside dimensions 159 smaller than the inside diameter 169 of the casing 103 so that there exists a gap 152 between the packing device 150 and the casing 103. After the packing device 150 has been placed at a selected or desired location (depth) in the wellbore 101, it is set to isolate section 160*a* from section 160*b* as explained in detail later. FIG. 1A shows a sectional view of a portion of the exemplary packing device 150 made according to one embodiment of the disclosure. In one configuration, the packing device 150 includes a bladder 172 that contains therein a material 174 that will expand when an electrical charge is applied thereto. In one aspect, the material 174 is an electro-active polymer. Electro-active polymers exhibit a change in size or shape when stimulated by an electric field, i.e., when subjected to an electrical charge. In one embodiment, the material 174 may include nanoparticles. In one aspect, the material 174 may include a nanotube areogel, made from an electrically-conductive material, such as carbon, and a corrosion resistant polymer matrix, such as a hydrogenated nitrile rubber (HNBR) or a fluoroelastomer, such as sold under the trade name of AFLAS, or another suitable flexible polymer material. HNBR possesses high tensile strength, low permanent set, high abrasion resistance and high elasticity. Such materials are commercially available and are thus not described in detail herein.

In the configuration shown in FIGS. 1 and 1A, an electric line 123 from the motor 120 supplies the electrical charge to the packer material 174. The pump 130 operated by the motor 120 receives the fluid from the wellbore via the pump intake and discharges such fluid into the packing material via hydraulic line 136 that runs from the pump discharge head 132 to the packer material 174. One or more sensors 180 may be provided at suitable locations along the string 100. In one aspect sensors 180 may be suitably placed in or proximate the packing device 150 to provide information about one or more parameters of interest relating to the device 150 and other downhole parameters, such as temperature of the material 174 in the bladder 172 and pressure inside the bladder 172. Sensors 180 may be placed at any other location to provide information relating to any desired downhole parameter and/or parameters relating to the surface 109. A controller 190 may be provided to control the supply of the electrical charge and the fluid to the packing device 150. In aspects, the controller 190 may be a computer-based system or unit that includes a processor 192, a suitable data storage device 194 and programmed instructions 196 for use by the processor 192. The controller 190 may also receive information from the sensors 180 and control the operation of the electrical submersible pump, the supply of the electrical charge and the supply of the fluid to the packing device 150 based on the information provided by the sensors and/or in accordance with the programmed instructions 196.

Figure 4:
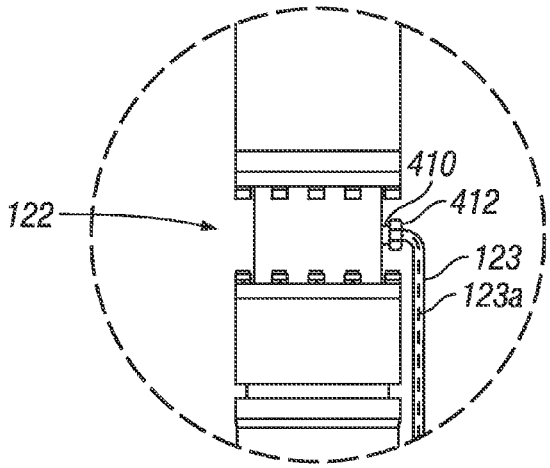
FIG. 4 shows an exploded view of section A of FIG. 1.
Figure 5:
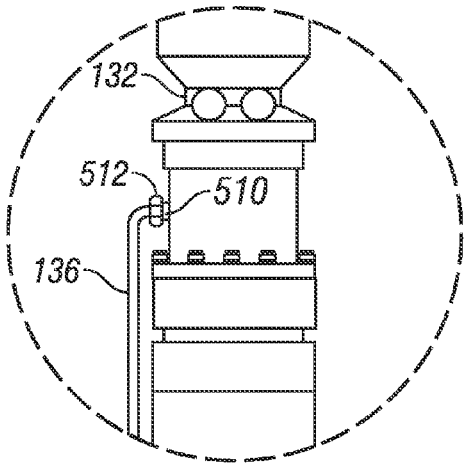
FIG. 5 shows an exploded view of section B of FIG. 1.
Figure 6:
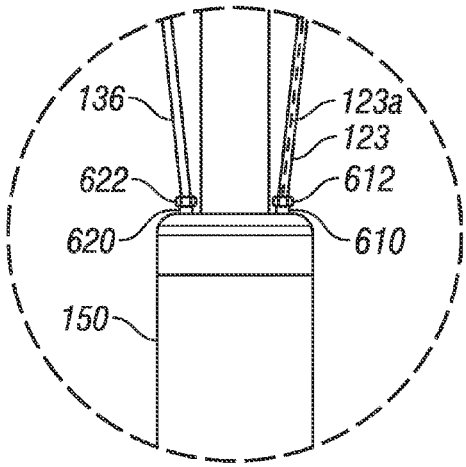
FIG. 6 shows an exploded view of section C of FIG. 1.

FIGS. 4-6 show exemplary connections of the electrical line 123 and the fluid line 136 between the motor 120 and pump 130, respectively, and the packing device 150. The electrical line 123 (FIG. 4) includes one or more links 123*a* for providing charge to the packer material 174 and for communication of data between the sensors 180 and the controller 190. In one configuration, the electrical line 123 may be coupled at one end to an electrical connection 410 at the motor base 122 via a suitable electrical connector 412 and at the other end to an electrical connection 610 (FIG. 6) at the packer 150 via a suitable connector 612. In one configuration, the fluid line 136 may be coupled at one end to a fluid or pump discharge pressure port 510 (FIG. 5) at the pump discharge head 132 via a suitable connector 512 and at the other end to a pressure port 620 (FIG. 6) at the packing device 150 via a suitable connector 622.

Figure 2:
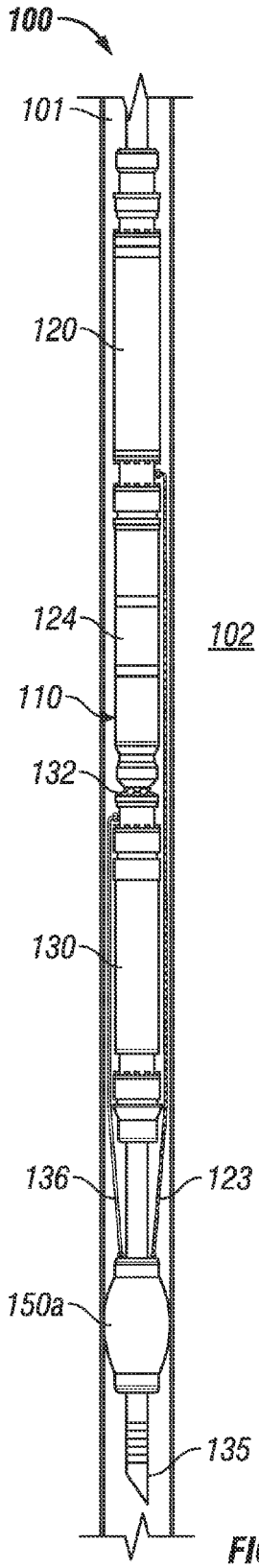
FIG. 2 shows the exemplary production string of FIG. 1 after the polymer composite has expanded due to the supplied electrical charge.
Figure 3:
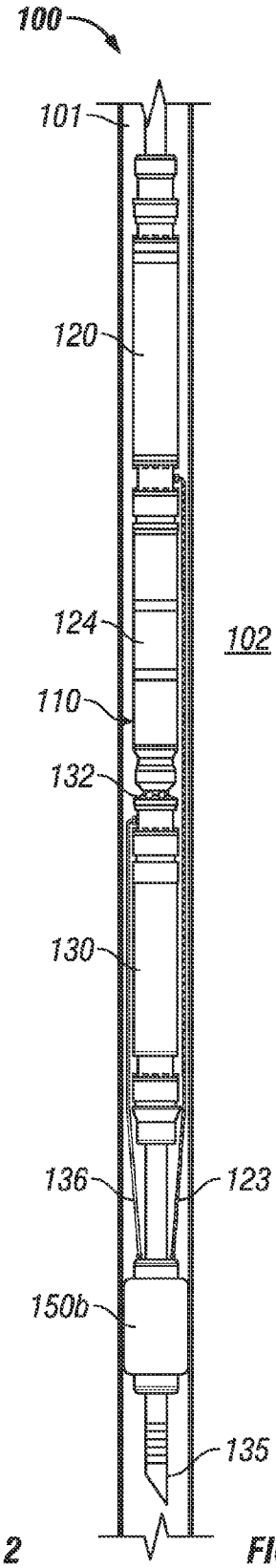
FIG. 3 shows the exemplary production string of FIG. 2 after the packing element has been hydraulically set.
Figure 2A:
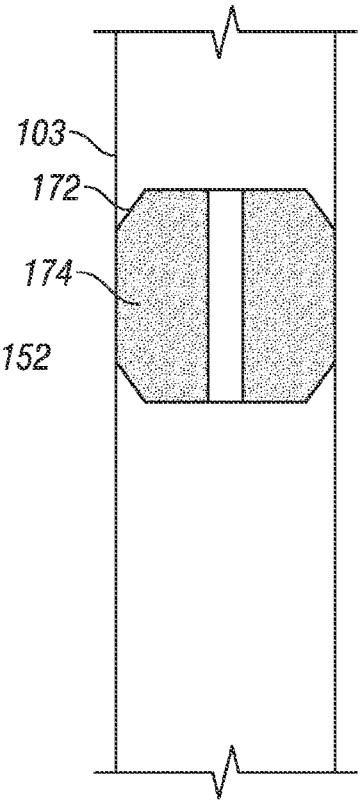
FIG. 2A shows a sectional view of the packing device of FIG. 2 after the polymer composite has expanded due to the supplied electrical charge.
Figure 3A:
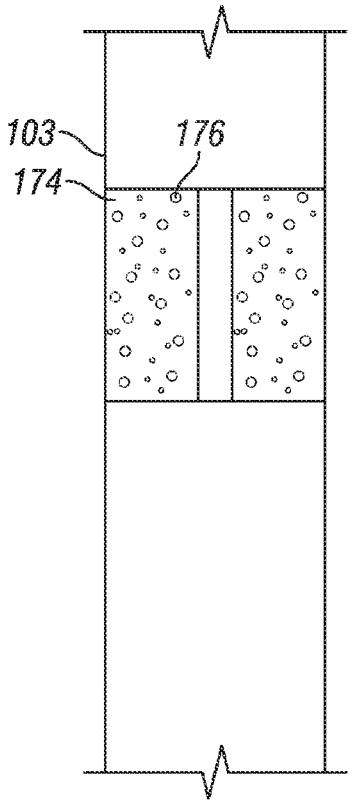
FIG. 3A shows a sectional view of the packing device of FIG. 3 after the packing device has been supplied with a fluid.

Once the string 100 has been placed in the wellbore 101 as shown in FIG. 1, the material 174 (FIG. 1A) is subjected to a suitable electrical charge to cause the material 174 to heat and expand in the bladder 151. FIG. 2 shows the packing device 150 in such an expanded state. In one aspect, the bladder 151 is dimensioned such that when the electrical charge is applied to the material 174, the bladder 151 expands and engages (presses against) the casing 103 and causes a pressure differential across the packing element 150 (between wellbore sections 160*a* and 160*b*). FIG. 2A shows the cross-section of the bladder 151 of the packing device 150 shown in FIG. 2. However, the force applied by the packing device 150 against the casing 103 in its engaged position may not be adequate to provide a desired seal between the packing device 150 and casing 103. The fluid 136*a* under pressure is pumped into the packing device 150, which increases the pressure inside of the bladder 151 and causes the bladder 151 to expand further to attain a modified shape shown in FIG. 3A. This increased pressure in the bladder 151 applies additional pressure onto the casing 103 to provide the desired seal between the casing 103 and the packer 150, thereby isolating the wellbore section 160*a* above the packing device 150 from the wellbore section 160*b* below the packing device 150. Thus, in one configuration, the method of setting the packing element 150 in the wellbore 101 may include: setting the string 100 in the wellbore 101 and turning on the motor 120, causing the motor to automatically supply the electrical charge to the material 174 and to operate the pump 130 to supply the fluid to the packing device 150. In another configuration, a delay may be provided between the supply of the electrical charge to material 174 and the supply of the fluid into the packing device 150. In yet another configuration, the supply of the electrical charge from the motor 120 to the material 174 and the supply of the fluid from the pump 130 to the packing device 150 may be controlled at the surface. Such operations may be controlled in response to the measurements provided by the sensors 180, such as pressure measurements. In other aspects, the material 174 may be configured such that it will contract when the electrical charge is removed from the material 174, causing the packing device 150 to disengage from the wellbore 101 allowing removal of the string 100 from the wellbore.

Thus, in one aspect, the disclosure provides a method of performing a wellbore operation that in one embodiment includes: providing a device comprising a composite material that expands from its original shape when the composite material is exposed to an electrical charge; placing the packing device in the original shape in the wellbore; supplying the electrical charge to the composite material to cause the composite material to expand to an expanded shape and to cause a pressure differential across the packing device; and supplying a fluid into the packing device to increase the pressure inside the packing device so as to seal an area about the packing device. In one configuration the composite material includes an electrically-conductive material and a base matrix. In one aspect the electrically-conductive material may include carbon nanotubes or carbon nanotube areogel. In aspects, the base matrix may be a polymer matrix containing a hydrogenated nitrile rubber or a fluorocarbon elastomer based on monomers tetrafluoroethylene and propylene. In this configuration, increasing the pressure in the packing device causes the packing element to seal against a member placed outside the packing device, which may be the wellbore or a tubular. The electrical charge may be supplied from a source in the wellbore, such as a motor associated with an electrical submersible pump or a source at the surface. The fluid may be supplied to the packing device from a pump in the wellbore or the surface. The supply of the electrical charge and the fluid may be controlled by a controller in response to a downhole measurement and/or programmed instructions provided t the controller.

The wellbore operation, according to another method, may comprise: placing a string in the wellbore, the string including a motor, a pump and a packing device that includes a bladder, a composite material in the bladder that expands from an original shape to an expanded shape when the composite material is exposed to an electrical charge; supplying the electrical charge to the composite material from the motor to cause the composite material to attain the expanded shape and to cause a pressure differential across the packing device in the wellbore; and supplying a fluid into the packing device from the pump to increase the pressure inside the packing device to cause the packing device to seal against a member in the wellbore.

In another aspect, an apparatus for use in a wellbore is provided. In one embodiment the apparatus may include: a device comprising a composite material, which composite material when exposed to an electrical charge expands from an original shape; a source of supplying the electrical charge to the composite material when the device is placed in the wellbore; and a source of supplying a fluid into the packing device configured to supply the fluid into the device when the device is placed in the wellbore. In one configuration the composite material is placed in a bladder configured to attain a shape that will provide a seal between the bladder and an element in the wellbore when the bladder is pressed against the element. The source supplying the electrical charge may be an electrical source in the wellbore or at the surface and the source supplying the fluid may be a pump in the wellbore or at the surface. A controller may be provided to control the supply of the electrical charge to the composite material and/or the supply of the fluid into the device. In addition, one or more sensors configured to provide signals representative of one or more downhole parameters may be deployed in the wellbore. The controller may be configured to control the supply of the electrical charge and/or the supply of the fluid in response to the sensor measurements. In aspects, the composite material may include electrically-conductive nanoparticles and a base matrix. Although the embodiments shown and described generally relate to packing devices, the concepts and methods described herein are applicable to any device that utilizes materials that may be electrically engaged and hydraulically set. The term "electrically engaged" as used herein means a device that acquires an expanded shape when it is subjected to an electrical charge or field. The term "hydraulically set" means a device that applies pressure on another member placed proximate to the device when a fluid is supplied to the device.

While the foregoing disclosure is directed to the preferred embodiments of the disclosure, various modifications will be apparent to those skilled in the art. It is intended that all variations within the scope and spirit of the appended claims be embraced.

The invention claimed is:

1. A method of performing a wellbore operation, comprising:

providing a device comprising a material configured to expand from a first shape to a second shape when the material is exposed to a selected charge;

placing the device with the material in the first shape in the wellbore;

providing the selected charge to the material to cause the material to expand to the second shape to expand the device to engage either an inside of the wellbore or an inside of a tubular in the wellbore; and supplying a fluid into the expanded device to increase the pressure inside the device to cause the expanded device to attain a shape that provides a seal between device and either the inside of the wellbore or the inside of the tubular in the wellbore.

2. The method of claim 1, wherein the material includes an electrically-conductive material and a base matrix.

3. The method of claim 2, wherein the electrically-conductive material is selected from a group consisting of: carbon nanotubes; a carbon nanotube areogel; nano-onions; multi-walled nanotubes; nanospheres of carbon; carbon; a shape memory material; an electrical material; and a high temperature material.

4. The method of claim 2, wherein the base matrix is a polymer matrix that includes one of: hydrogenated nitrile rubber and a fluorocarbon elastomer based on monomers tetrafluoroethylene and propylene.

5. The method of claim 1, wherein the selected charge is one of: an electrical charge; and heat.

6. The method of claim 1 further comprising deploying a motor and a fluid supply device in the wellbore, the method further comprising: supplying the selected charge to the material from the motor and supplying the fluid by the fluid supply device.

7. The method of claim 1 further comprising controlling the supply of the electrical charge and the fluid using a controller.

8. The method of claim 1 further comprising controlling at least one of the supply of the electrical charge and the supply of the fluid in response to a measurement made by a sensor.

9. A method of performing a wellbore operation, comprising:

placing a string in the wellbore, the string including a motor, a pump and a packing device that includes a flexible member containing a selected material therein that is configured to expand from an original shape to an expanded shape in the wellbore when the material is exposed to an electrical charge;

supplying the electrical charge to material from the motor to cause the material to attain the expanded shape to engage the packing device against either an inside of the wellbore or an inside of a tubular in the wellbore; and supplying a fluid into the engaged packing device in the expanded shape using the pump to increase the pressure inside the packing device to cause the packing device to attain a shape that provides a seal between the packing device and either the wellbore or the tubular.

10. The method of claim 9, wherein the material includes electrically-conductive nanoparticles and a polymer matrix.

11. The method of claim 10, wherein the electrically-conductive material includes one of: carbon nanotubes; and a carbon nanotube areogel.

12. The method of claim 11, wherein the polymer matrix is selected from a group consisting of: hydrogenated nitrile rubber; and a fluorocarbon elastomer based on monomers tetrafluoroethylene and propylene.

13. An apparatus for use in a wellbore, comprising:

a device comprising a selected material configured to expand when exposed to an electrical charge from an original shape to an expanded shape;

an electrical source configured to supply the electrical charge to the selected material when the device is placed in the wellbore to expand the device to engage either an inside of the wellbore or an inside of a tubular in the wellbore; and a fluid source configured to supply a fluid into the engaged device to cause the engaged device attain a shape that provides a seal between the device and either the wellbore or the tubular in the wellbore.

14. The apparatus of claim 13, wherein the electrical source configured to supply the electrical charge is a power supplied to the motor and the fluid source is a pump configured to be placed in the wellbore.

15. The apparatus of claim 13, wherein the selected material includes electrically-conductive nanoparticles and a base matrix.

16. The apparatus of claim 15, wherein the electrically-conductive material includes a material selected from a group consisting of: carbon nanotubes; a carbon nanotube areogel; nano-onions; multi-walled nanotubes; nanospheres of carbon; carbon; a shape memory material; an electrical material; and a high temperature material.

17. The apparatus of claim 13 further comprising a controller configured to control at least one of: the electrical source to supply the electrical charge to the composite material and the fluid source to supply the fluid into the device.

18. The apparatus of claim 13, wherein the fluid source is configured to supply the fluid into the device to increase pressure inside the device to cause the device to attain the shape that provides the seal between the device and either the wellbore or the tubular in the wellbore.

* * * * *